United States Patent [19]

Grudzinskas

[11] Patent Number: 4,581,502

[45] Date of Patent: Apr. 8, 1986

[54] CIRCUIT BREAKER LOCKING DEVICE AND METHOD, AND LOCK FORMING TOOL

[76] Inventor: Charles A. Grudzinskas, 3990 McCabe Ave., NE., Ada, Mich. 49301

[21] Appl. No.: 582,380

[22] Filed: Feb. 22, 1984

[51] Int. Cl.[4] ..... H01H 3/20

[52] U.S. Cl. ..... 200/43.16

[58] Field of Search ..... 200/42 T, 327, 43.16

[56] References Cited

U.S. PATENT DOCUMENTS

| | | | |
|---|---|---|---|
| 2,937,248 | 5/1960 | Michetti | 200/42 T |
| 4,006,324 | 2/1977 | Leasher et al. | 200/42 T |
| 4,435,624 | 3/1984 | Sepulveda | 200/42 T |
| 4,467,152 | 8/1984 | Gordi | 200/42 T |

*Primary Examiner*—Stephen Marcus
*Assistant Examiner*—Renee S. Kidorf
*Attorney, Agent, or Firm*—Price, Heneveld, Huizenga & Cooper

[57] ABSTRACT

A lock and method for locking circuit breakers, as well as a tool for making such circuit breaker locks. The circuit breaker lock comprises a U-shaped member with a portion of one of the arms of the U being bent away from the other out of the plane of the U, the bent portion forming a foot. The other of the arms is insertable into a bore which extends through the toggle switch on a circuit breaker. The circuit breaker is locked by placing the foot against a portion of the circuit breaker housing such that the switch cannot be urged from its locked position. The tool used for making such circuit breaker locks has first and second jaws which are movable toward and away from each other. A U-shaped bracket is mounted on the first jaw, which bracket receives the second jaw as it is moved toward the first. The bracket has two spaced supports which receive the second jaw therebetween when it is moved toward the first and project away from the first jaw. A piece of wire can be placed across the tops of the supports and bent into a U-shape as the jaws are moved toward each other. Thereafter, one of the arms of the U-shaped portion can be bent to form the foot of the circuit breaker lock.

8 Claims, 16 Drawing Figures

CIRCUIT BREAKER LOCKING DEVICE AND METHOD, AND LOCK FORMING TOOL

BACKGROUND OF THE INVENTION

The present invention relates to locks and methods for locking circuit breaker switches, as well as to tools for making such locks.

A circuit breaker of the type relevant to this invention has a toggle switch and is pivotal from "on" to "off" positions to activate or deactivate the circuit. The breaker also has an electromagnet or other means which trips or opens the circuit in overload, underload, overvoltage or under-voltage conditions. The electromagnet does not necessarily move the toggle switch from its on position when the circuit is tripped. The toggle switch is used, however, to reset or close the circuit after the breaker trips by turning the toggle to the "off" and then back to the "on" position.

The toggle switch allows the manager of a building or other structure to deactivate the associated circuit when it is not use, which is typically done at night to save energy. However, precautions must be taken to avoid turning off essential circuits, such as those required for night lighting, heating, security and/or refrigeration. Where many circuit breakers are on a panel board, however, it is easy to mistakenly deactivate the wrong circuit breakers at the end of a long business day. This, of course, can have disastrous consequences if perishables spoil or pipes freeze, for example.

Therefore, circuit breaker locks are employed to prevent the wrong breaker from being turned off. Heretofore, such locks typically have a collar which slidably fits onto the toggle switch and is secured thereto by screws which either screw into the bore provided through the conventional toggle switch or tighten the collar to grip the toggle switch, securing the lock to the toggle switch in either event. Such a lock also typically has a projection integrally formed with the collar, which abuts the circuit breaker housing if the switch is urged from its locked position, thereby preventing movement of the switch from that position.

Although such locks are quite effective, they are often difficult to remove, when removal is necesary to reset the associated circuit breaker. Circuit breakers are generally positioned close to each other in vertical columns on panel boards, switchboards or other control centers. When two or more adjacent circuit breakers have locks on them, the lock on one switch can prevent the lock on an adjacent, tripped breaker from being removed. This is due to the fact that the former switch creates an obstacle to the removal of the screw on the latter lock, since the screw often cannot be reached by a screwdriver without flipping the former switch. Of course, the former toggle switch cannot be flipped without removing the lock thereon. Thus, the lock on the former switch must be removed as well. If a series of adjacent switches have such locks, an entire row or column of locks may have to be removed to remove the lock on a tripped circuit breaker in order to reset the tripped circuit breaker in the manner described above, since each lock can be an obstacle to the removal of an adjacent lock. Needless to say, such an operation is time-consuming and frustrating.

A further disadvantage of prior art circuit breaker locks is that they typically cannot be made by the electrician on the job. Therefore, if the electrician exhausts his supply of such locks, he must stop work to go elsewhere and obtain more.

SUMMARY OF THE INVENTION

The present invention is a method and device for locking circuit breakers of the type having a housing and a toggle switch projecting from the housing, the switch being pivotal between two positions and having a bore therethrough normal to the plane through which the toggle switch pivots. A length of bendable material is bent into a generally U-shaped member having two upright arms. A portion of the end of one of the arms is bent away from the other at an angle to the plane of the U to form a foot. The other arm is inserted into the bore in the toggle switch when the toggle is in a first position. The foot of the lock engages a portion of the housing in the general direction of the second position of the toggle switch. Therefore, since the one arm engages the toggle switch in the first position, and the foot engages the housing portion, the switch cannot be pivoted to the second position from the first.

The present invention further includes a tool for making the above described circuit breaker lock. The tool includes first and second jaws with means for moving them toward and away from each other. A U-shaped bracket is mounted on the first jaw and receives the second jaw therein as it is moved toward the first. The bracket has two spaced supports which project away from the first jaw and generally toward the second. Thus, a length of bendable material can be placed across the tops of the supports and bent into a U-shape as the jaws are moved toward each other. The foot can be made by bending a portion of the end of one arm at an angle to the plane of the U-shaped member while the member is clamped between the jaws.

The circuit breaker lock of the present invention is removable from a tripped breaker without having to remove the circuit breaker locks on adjacent breakers. Furthermore, the circuit breaker lock of the present invention can be made on-site by the worker using the circuit breaker lock forming tool of the present invention. Since the circuit breaker tool of the present invention can take the form of a pliers-like tool, and the lock made from wire, the locks can be quickly and easily made by hand for a fraction of the cost of prior art locks.

DETAILED DESCRIPTION OF THE PREFERRED EMBODIMENT

Figure 4:
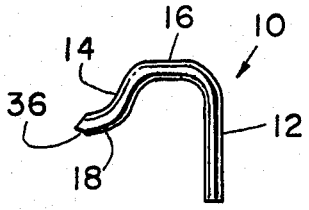
FIG. 4 is a top elevation of a right-handed circuit breaker lock of the present invention.

The circuit breaker lock 10 of the present invention is made from a length of wire or other bendable material and formed into a generally U-shaped member having two arms 12, 14 (FIG. 4 and 5) and a bottom portion 16 intermediate and connecting the arms. A portion of the end of arm 14 is bent away from arm 12 and out of the plane of the U (FIG. 5) to form a foot 18.

Figure 1:
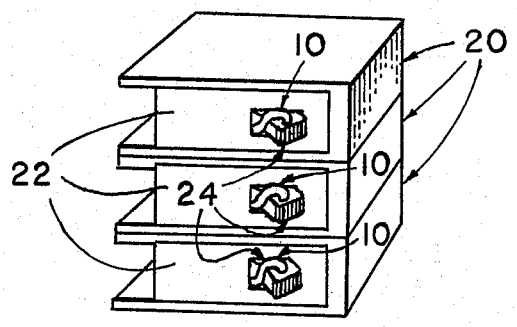
FIG. 1 is a perspective view of a row of switches having circuit breaker locks of the present invention thereon.
Figure 2:
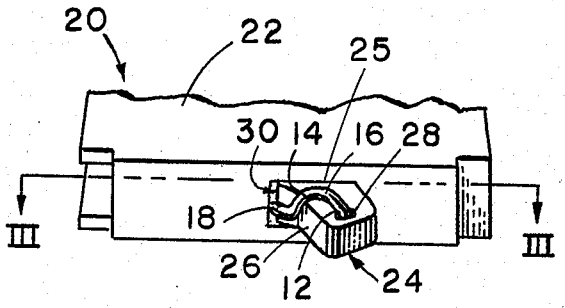
FIG. 2 is a detail perspective view of a circuit breaker having a toggle switch with a circuit breaker lock thereon.
Figure 3:
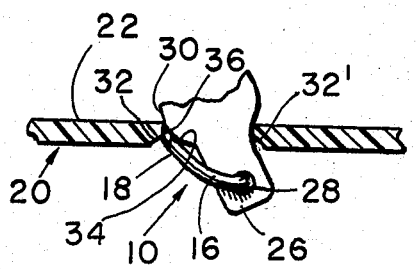
FIG. 3 is a cross-sectional view of the circuit breaker, taken along the plane of line III—III of FIG. 2.

As shown in FIGS. 1 and 2, a common type of circuit breaker 20 includes a housing 22 and a toggle switch 24 which is pivotal from an "on" position, shown in FIGS. 1–3, to an "off" position (not shown) in a well known manner. Toggle 24 has a lever portion 26 which is grasped to pivot toggle 24 from the "on" to the "off" position. An aperture or bore 28 passes through lever portion 26 in a direction generally normal to the plane through which toggle switch 24 pivots when being moved from the "on" to the "off" position, or vice versa. Switch 24 projects through a rectangular opening 25 in housing 20. The two short shdes of opening 25 define shoulders 32, 32', each of which supports switch 25 in its "off" and "on" positions, respectively.

Circuit breaker 20 has an electromagnet or other means (not shown) inside housing 22 which trips or opens the circuit to which the breaker is electrically connected in overload, underload, over-voltage and under-voltage conditions. The tripping device is housed within housing 22 and does not move toggle switch 24 from its "on" position when such conditions occur. Toggle 24 is used, however, to reset or close the circuit after the breaker trips internally by turning the toggle to the "off" and then back to the "on" position in a conventional fashion. The bore 28 through toggle 24 is provided typically on the original circuit breaker by the manufacturer for the installation of prior art-type locks. Thus, there is no need to drill a bore through the toggle to use the lock of the present invention.

To lock a circuit breaker in position, arm 12 of lock 10 is inserted into bore 28 through toggle 24. Owing to the generally L-shape prop defined by arm 12, bottom 16 and the unbent portion of arm 14, lock 10 wraps partly around toggle 24 such that foot 18 can be pointed generally toward the alternate or "off" toggle switch position. The switch 24 is locked in position by pivoting lock 10 on arm 14 in bore 28 such that foot 18 extends into a gap 30 defined between shoulder 32 (FIG. 3) of housing 22 and a curved shroud 34 of toggle 24.

Figure 5:
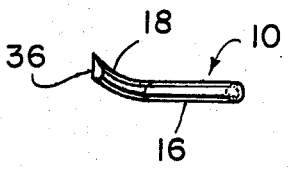
FIG. 5 is a side elevation of a right-handed circuit breaker lock of the present invention.
Figure 6:
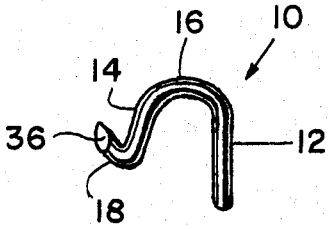
FIG. 6 is a bottom elevation of a right-handed circuit breaker lock of the present invention.

Foot 18 is curved away from arm 12 and out of the plane defined by arm 12 and bottom 16 (FIGS. 3 and 5) such that it can curve downwardly into gap 30. When foot 18 engages shoulder 32 of housing 22 in this manner and arm 12 is inserted into bore 28, toggle 24 cannot be moved from its position because the dimensions of the lock are such that the lock fits interferingly or wedgingly between switch 24 and shoulder 32. Foot 18 is roughly perpendicular to arm 12 as well so that when arm 12 is inserted into bore 28, foot 18 can be pivoted in an arc around arm 12 into gap 30 as arm 12 is pivoted within bore 28. To insure further that foot 18 will not become dislodged from gap 30, a barb 36 is formed at the end of foot 18 and is angled as shown in FIGS. 3 and 5 such that the end of foot 18 conforms generally to the cross-sectional configuration of gap 30.

When a plurality of circuit breakers 20 are mounted in vertical columns or rows (FIG. 1) on panel boards or other control centers, any one circuit breaker lock can be removed without removing the adjacent circuit breaker locks. Bottom portion 16 and arm 14 can be grasped between the index finger and thumb and pulled away from housing 22 pivotally about arm 12 in bore 28 such that foot 18 is removed from gap 30. Toggle 24 can then be flipped to the alternate position and arm 12 can be removed from bore 28. Arm 12 is removed from bore 28 after toggle 24 is moved to the alternate position for the simple reason that in most situations there is not enough room between adjacent switches to permit arm 12 to be removed completely from bore 28 because an adjacent switch will interfere with the removal.

If removal cannot be accomplished by pulling foot 18 out of gap 30 by hand, the tip of a screwdriver can be placed between foot 18 and shroud 34, and foot 18 can be pried from gap 30 simply by turning the screwdriver slightly. Generally, there is little interference from adjacent switch to a screwdriver being placed between foot 18 and shroud 34. By contrast, a prior art circuit breaker lock employs a screw which generally cannot be reached with a screwdriver if an adjacent locked circuit breaker has a prior art circuit breaker lock thereon.

It should be noted that the lock 10 which locks toggle 24 in its right or "on" position (FIGS. 1–3) is preferably not used to lock toggle 24 in its left or "off" position. Even though the wedging of lock 18 between the housing and the switch will substantially prevent it from falling off the circuit breaker in such a situation, it is preferably that arm 12 and bottom 16 hook onto toggle 24 absolutely ruling out the possibility that lock 10 will fall from toggle 24 under the influence of gravity. If toggle 24 was pivoted to the left or "off" position, arm 12 could be inserted through the upper end of bore 28, but foot 18 would be oriented away from gap 30 due to its curvature.

Figure 7:
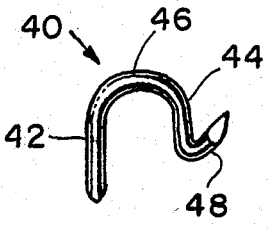
FIG. 7 is a bottom elevation of a left-handed circuit breaker lock of the present invention.
Figure 8:
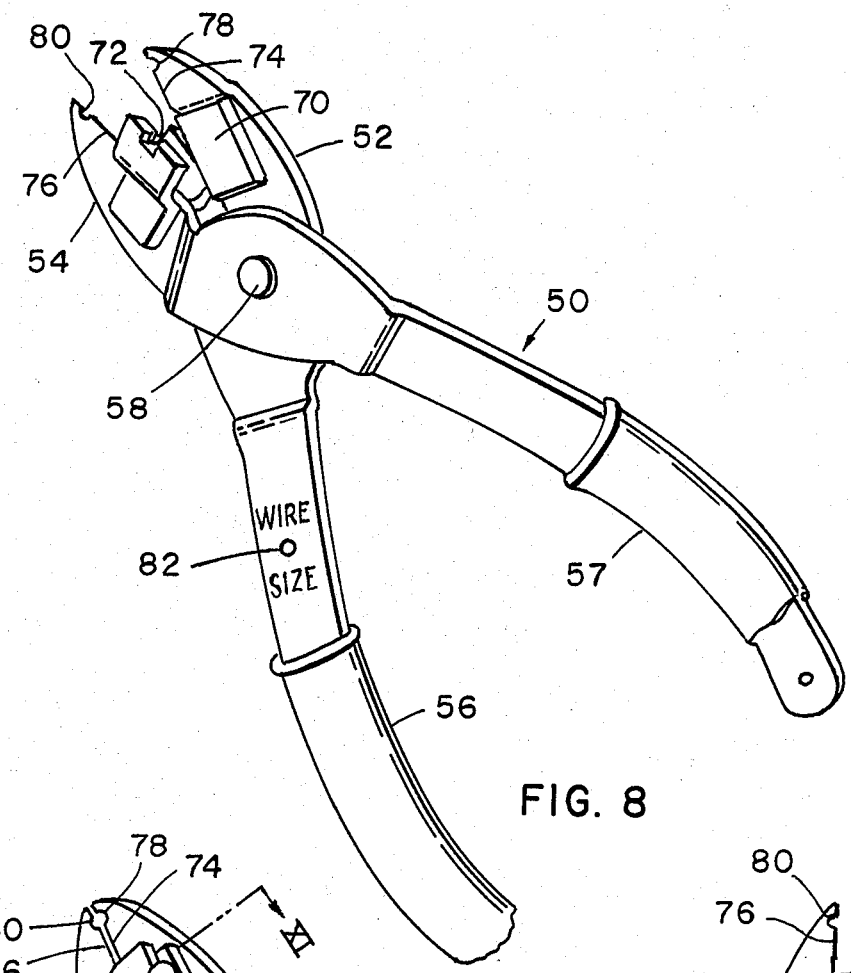
FIG. 8 is a perspective view of a circuit breaker lock forming tool of the present invention, with a portion thereof broken away to reveal internal construction.

Accordingly, rather than inserting arm 12 through the bottom end of toggle 24 so that foot 18 could engage shoulder 32' when switch 24 is in the "off" position, a "left-handed" circuit breaker lock 40 (FIG. 7) is used. Lock 40 has an arm 42 insertable into bore 28, an arm 44 and bottom 46 intermediate and connected to the arms forming a generally U-shaped member. A portion of arm 44 is bent away from arm 42 and out of the plane of the "U" to form a foot 48. Lock 40 is essentially identical to lock 18 except that it is the mirror image thereof, foot 48 being bent in a direction in relation to the plane of the "U" opposite from the direction of foot 18. Accordingly, arm 42 can be inserted through the upper end of bore 28 and foot 48 can engage the gap formed by toggle 24 and shoulder 32' when the switch is in the left or "off" position. Therefore, lock 40 cannot fall from toggle 24 under the influence of gravity.

A tool which can be used to make either the right-handed lock 10 or left-handed lock 40 is illustrated in FIGS. 8–16. The lock forming tool 50 has an upper jaw 52 and a lower jaw 54 and means for urging the jaws toward and away from each other such as handles 56 and 57. Jaw 52 and handle 56 form one integral piece. The jaws and the handles together form a pliers-like type of tool, which is pivotally secured together by a fastener, such as rivet 58. Two brackets 60, 62 each having a generally Z-shaped section (FIG. 11) are secured to the sides of lower jaw 54 forming two spaced supports 64 and 66 which receive upper jaw 52 between them when jaw 52 is moved toward jaw 54. Supports 64 and 66 and jaw 54, in turn, create a U-shaped stamping region or bracket means 68 in which a U-shaped member can be formed and made into either lock 10 or lock 40.

Preferably, one of the supports, support 62, for instance, has a notch 72 open through its top to facilitate the bending of one of the arms of the U-shaped member clamped between the jaws of the tool and to form foot 18 or 48.

Figure 11:
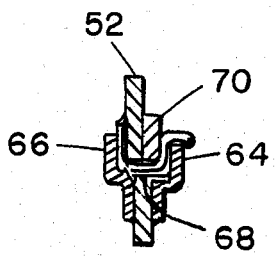
FIG. 11 is a perspective taken along the plane of line XI—XI of FIG. 10.
Figure 12:
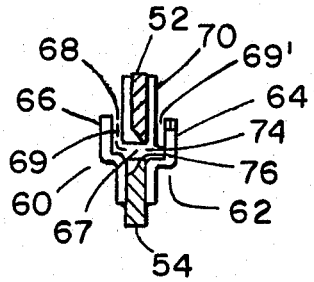
FIG. 12 is a cross section taken along the plane of line XII—XII of FIG. 9.

Upper jaw 52 has a jaw spacer 70 in the form of a rectangular piece of metal secured to jaw 52 which increases the effective width of jaw 52. Accordingly, when jaw 52 and spacer 70 are urged toward jaw 54 and between supports 64, a well-defined U-shaped is imparted to a length of wire placed across the tops of supports 64 and 66 and then clamped between the jaws as shown in FIG. 11. So that a thickness of wire can fit between the jaws when they are closed, the jaws do not meet in the stamping region. Instead a gap 67 (FIGS. 9 and 12) is provided between jaws 52 and 54 in the stamping region, and gaps 69, 69' (FIG. 12) are provided between jaw 52 and supports 64, 66, respectively, when the jaws are closed. Gaps 67, 69 and 69' are roughly as wide as the diameter of the largest diameter wire to be placed between the jaws.

To form the U-shaped member, a straight length of wire or other bendable material should be placed across the tops of supports 62 and 64 with portions of the wire at least of sufficient lengths to form the arms of the U-shaped member overhanging the supports, and with the part of the wire contacting support 62 being positioned in notch 72. The jaws are clamped by manually squeezing handles 56 and 57 together, whereupon the length of wire is bent into a U-shape, the arms of the U being parallel to each other and to supports 62, 64 on either side of jaw 52. Although it is no longer in notch 72, the arm of the U-shaped member adjacent support 64 remains aligned with notch 72, for reasons which will become apparent.

Figure 10:
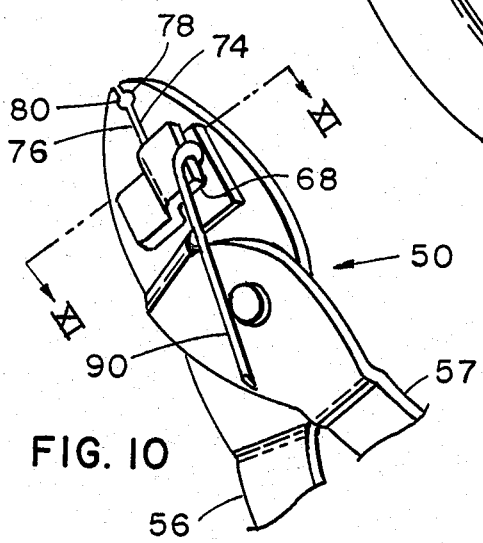
FIG. 10 is a partly broken perspective view of the circuit breaker lock forming tool of the present invention having a partially formed circuit breaker lock between its jaws.
Figure 14:
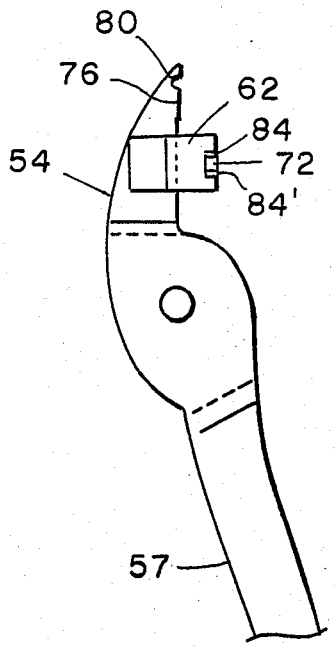
FIG. 14 is a partly broken side view of a second jaw of the circuit breaker lock forming tool.

To form foot 18, for instance, from the U-shaped member clamped between jaws 52 and 54, the arm of the U-shaped member adjacent support 64 is bent first 90° downwardly into notch 72 in the plane of the "U" away from the other arm of the U. Then the bent arm is bent again about 45° out of the plane of the "U" toward the handles as shown in FIGS. 10 and 11, notch 72 acting as a fulcrum for the bending of the arm. It should be obvious that the arm can easily be bent by hand as described if a substantial excess length of wire 90 is provided on the arm to be bent as shown in FIG. 10. Next, the bent arm or foot 18 of the U-shaped member is trimmed to an appropriate length by cutting off the excess.

To form foot 48, the arm of the U-shaped member adjacent support 64 is bent first 90° downwardly into notch 72, in the plane of the "U" away from the other arm. Then, the bent arm is bent again about 45° out of the plane of the "U" away from the handles of the tool. Foot 48 is then trimmed to an appropriate length.

Figure 16:
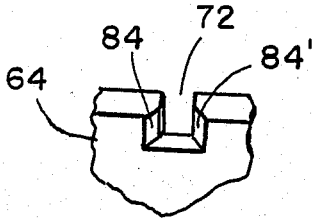
FIG. 16 is a detail perspective view of one half of a bracket mounted on one of the jaws of the lock forming tool.

The 45° bending of the arms can be facilitated by beveling the parallel edges of notch 72 facing away from support 66 at 84 and 84' as shown in FIG. 16.

Preferably, jaws 52 and 54 are provided with cutting edges 74 and 76 along the mating surfaces of the jaws at the nose of the tool 50 forward of the stamping region. Cutting edges 74 and 76 can be used to trim any excess material from the wire bent into the locks and to form barb 36 at the end of foot 18.

Figure 9:
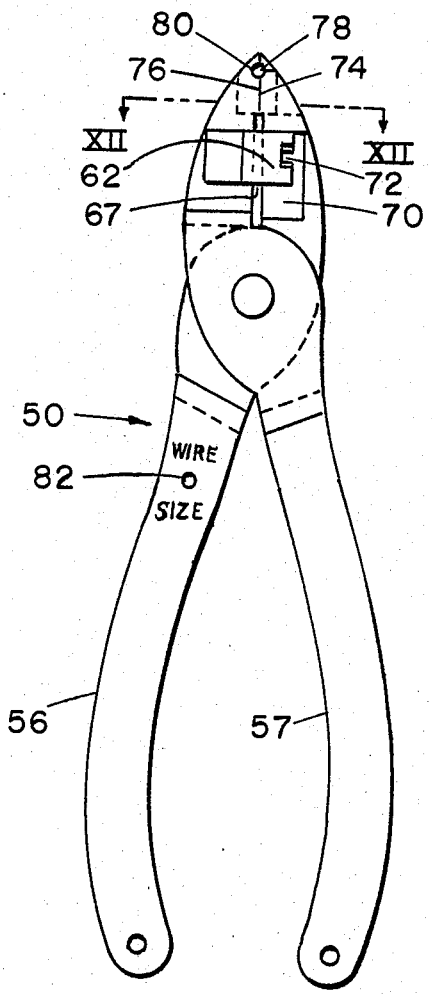
FIG. 9 is a side elevation of a circuit breaker lock forming tool of the present invention.
Figure 13:
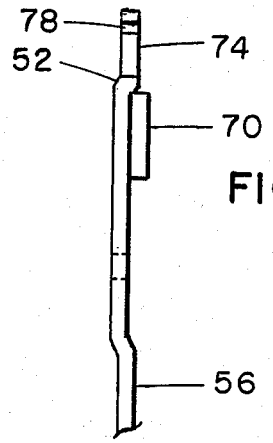
FIG. 13 is a partly broken bottom view of a first jaw of the circuit breaker lock forming tool of the present invention with the handle associated with said first jaw.
Figure 15:
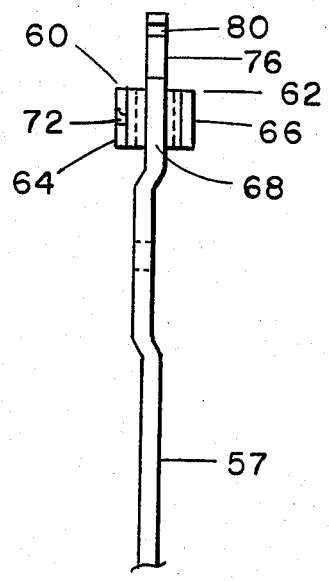
FIG. 15 is a partly broken top elevation of the second jaw of the circuit breaker forming tool.

Cutting edges 74 and 76 each are provided with notches 78 and 80, respectively, which mate when the jaws are closed (FIGS. 9 and 10). After the excess is trimmed from the portion of the lock forming the foot, the foot can sometimes be somewhat too long to be inserted into the gap. This can be remedied by placing each of the arms, for instance arms 12 and 14, into one of the notches 78 and 80 and compressing the lock slightly by squeezing handles 56 and 57 such that arms 12 and 14 are brought closer together, thereby making it possible for foot 18 to fit into gap 30. If the arms 12 and 14 are compressed too close together, they can be spread apart by placing the lock in the U-shaped stamping region 68 and clamping it between the jaws once more.

To guard against the possibility that a wire having too wide a diameter will become jammed between the jaws, a wire diameter gauge hole 82 is provided through one of the handles. Gauge hole 82 has a diameter equal to the diameter of the largest diameter wire that can fit between jaws 52 and 54 without jamming, hole 82 having a diameter approximately equal to the width of any one of gaps 67, 69 and 69'. The wire to be bent can be compared to the allowable maximum diameter by inserting it into hole 82. If the wire fits, it will not become jammed between the jaws.

As is apparent from the foregoing, circuit breaker locks can be produced inexpensively and installed easily according to the teachings of the present invention. Furthermore, such locks are easy to remove even when adjacent circuit breaker toggle switches have circuit breaker locks thereon. Of course, it is understood that the above is merely a preferred embodiment of the invention and that various changes and alterations may be made without departing from the spirit and broader aspects of the invention.

The embodiments of the invention in which an exclusive property or privilege is claimed are defined as follows:

1. A method for locking circuit breakers, comprising:

(a) providing a selected circuit breaker of the type having a housing and a toggle switch projecting from said housing being pivotal between two positions and having a bore therethrough normal to the plane through which said toggle switch pivots;

(b) manually bending a length of elongated, bendable rod material into a generally U-shaped member having a first upright arm and a second upright arm;

(c) bending a portion of the end of said second arm to extend away from said first arm and at an angle to the plane of said U to form a foot;

(d) manually adapting said foot to said selected circuit breaker by adjusting the length of said foot to engage said housing when said first arm is inserted into said bore with said toggle in a first position;

(e) inserting said first arm into said bore when said toggle is in a first position, such that said first arm only is received in said toggle and said foot extends to a free end;

(f) engaging a portion of said housing in the general direction of the second position of said toggle switch with said free end of said foot, whereby said rod is configured into a circuit breaker lock particularly adapted to said selected circuit breaker, in which said first arm engages said toggle switch in said first position and said free end of said foot engages said housing portion preventing said switch from being pivoted to said second position.

2. The method for locking circuit breakers as recited in claim 1 which further includes: forming a barb on the end of said foot, said barb being engageable with said housing portion.

3. The method for locking circuit breakers as recited in claim 2 wherein said engagement step includes inserting said barbed foot into a gap formed between said toggle switch and said housing.

4. In combination, a conventional circuit breaker having a housing with an opening therethrough, a circuit breaking means within said housing, and a toggle projecting through said opening and having a laterally extending bore therethrough; and a lock for said circuit breaker comprising: a lock element made from an elongated piece of manually bendable and severable rod material, said lock element having a first arm slidably inserted into said bore, said lock element having a second arm outside of said bore and coupled to said first arm, and said lock element including a foot having a first end thereof connected with said second arm to define a connecting angle of less than 180 degrees therebetween, said foot extending generally perpendicular to said first arm and having an arm spacing between said foot first end and said first arm, said foot extending to a second free end thereof in abutting contact with said housing, said foot having a selected length and said connecting angle being adapted to said arm spacing such that said lock is wedgingly retained in place on said circuit breaker between said housing and said switch.

5. A circuit breaker lock for conventional circuit breakers of the type having a housing, and a toggle switch projecting therefrom with a laterally extending bore, and being pivotable between open and closed positions, said lock comprising:

a generally L-shaped prop made from an elongated piece of manually bendable and severable rod material, including:

a first arm having a lateral cross-sectional shape configured for close insertion into the bore in the toggle switch;

a second arm coupled to said first arm and disposed to be outside of said bore when said first arm is inserted therein;

a foot, having a first end thereof connected with said second arm to define a connecting angle of less than 180 degrees therebetween, said foot extending generally perpendicular to said first arm and said foot first end having an arm spacing between said first end and said first arm, said foot having a second free end thereof shaped for abutting contact with the circuit breaker housing; said foot having a selected length and said connecting angle being adapted to said arm spacing such that said second free end engages the circuit breaker housing when the toggle switch is in the closed position to wedgingly retain the toggle switch in place, and thereby prevent the toggle switch from being inadvertently shifted into the open position.

6. The circuit breaker lock as recited in claim 5 wherein said lock is generally U-shaped with a part of one of the arms of said U being bent away from the other out of the plane of said U forming said foot portion, the other of said arms being said insertable arm.

7. The circuit breaker lock as recited in claim 6 wherein the end of said foot has a barb projecting therefrom.

8. The circuit breaker lock as recited in claim 7 wherein said lock is made from a length of wire.

* * * * *

UNITED STATES PATENT AND TRADEMARK OFFICE

CERTIFICATE OF CORRECTION

PATENT NO. : 4,581,502

DATED : April 8, 1986

INVENTOR(S) : Charles A. Grudzinskas

It is certified that error appears in the above-identified patent and that said Letters Patent is hereby corrected as shown below:

Column 1, line 22:
Before "use" insert --in--

Column 3, line 28:
"Fig." should be --Figs.--

Column 3, line 43:
"shdes" should be --sides--

Column 4, line 39
"switch" should be --switches--

Column 4, line 50:
"preferably" should be --preferable--

Signed and Sealed this

Fourteenth Day of October, 1986

[SEAL]

*Attest:*

DONALD J. QUIGG

*Attesting Officer*

*Commissioner of Patents and Trademarks*